US007318952B2

(12) United States Patent
Keeton

(10) Patent No.: US 7,318,952 B2
(45) Date of Patent: Jan. 15, 2008

(54) RESIN COATED FLEXIBLE SUBSTRATES FOR PRINTING HIGH TEMPERATURE RESISTANT IMAGES

(75) Inventor: Mark Keeton, Dayton, OH (US)

(73) Assignee: NCR Corporation, Dayton, OH (US)

( * ) Notice: Subject to any disclaimer, the term of this patent is extended or adjusted under 35 U.S.C. 154(b) by 471 days.

(21) Appl. No.: 10/990,783

(22) Filed: Nov. 17, 2004

(65) Prior Publication Data

US 2006/0105120 A1 May 18, 2006

(51) Int. Cl.
*B41M 5/40* (2006.01)

(52) U.S. Cl. ..... 428/32.39; 428/32.5; 428/32.51; 428/32.52; 428/40.5; 428/42.1; 428/42.2; 428/195.1; 428/914; 156/230

(58) Field of Classification Search ..... 428/32.39, 428/32.5, 32.51, 32.52, 40.5, 42.1, 42.2, 428/195.1, 914; 156/230
See application file for complete search history.

(56) References Cited

U.S. PATENT DOCUMENTS

| | | | | |
|---|---|---|---|---|
| 5,610,233 | A | 3/1997 | Sharma | |
| 6,398,898 | B1 * | 6/2002 | Fukui et al. | 156/235 |
| 6,551,397 | B2 | 4/2003 | Weitzel et al. | |
| 6,607,811 | B1 * | 8/2003 | Puckett et al. | 428/195.1 |
| 6,669,769 | B2 | 12/2003 | Smith | |

* cited by examiner

*Primary Examiner*—Milton I. Cano
*Assistant Examiner*—David J. Joy
(74) *Attorney, Agent, or Firm*—Millen, White, Zelano & Branigan, PC; Charles Q. Maney

(57) ABSTRACT

Disclosed are resin coated flexible substrates, such as labels, including spine labels for CDs and DVDs which are adapted for thermal transfer printing, methods for preparing and printing on these resin coated flexible substrates and the printed substrates obtained therefrom. The printed substrates have images which are stable even when subjected to the heat and abrasion from a process which provides a shrink-wrap over the printed substrate.

20 Claims, 1 Drawing Sheet

RESIN COATED FLEXIBLE SUBSTRATES FOR PRINTING HIGH TEMPERATURE RESISTANT IMAGES

The present invention relates to resin coated flexible substrates, such as labels, including spine labels for CDs and DVDs which are adapted for thermal transfer printing, methods for preparing and printing on these resin coated flexible substrates and the printed substrates obtained therefrom. The printed substrates have images which are stable even when subjected to the heat and abrasion from a process which provides a shrink-wrap over the printed substrate. The resin coated flexible substrates are, for example, CD or DVD spine labels, illustrated in FIGS. 1 and 2, and protective or security seals on a variety of products, e.g., pharmaceuticals, cosmetics, etc., or barcodes printed on surfaces that are applied to a product, or labels of any type. Preferably the invention relates to CD or DVD spine labels, but the discussion, while focusing on these products, is not limited thereto, but is applicable generally to all other types of flexible substrates that need to have printed images which are resistant to heat and abrasion, such as that from a shrink-wrapping process.

CD and DVD spine labels are currently printed on demand before application to the jewel case. An example of a conventional print on demand system which is preferred is a thermal transfer printer using thermal transfer ribbons. After the label has been printed, it is applied to the CD or DVD jewel case, and the jewel case is then shrink-wrapped. Two common methods of sealing the shrink-wrap employ either a heat bar or a heat tunnel. The heat tunnels are non-contact and allow the use of a wax or a wax/resin blend thermal transfer ribbon. However, the heat bar actually comes in contact with the printed area and will transfer print from a spine label to the inside of the shrink-wrap, causing what is called "picking." To avoid this, a resin based thermal transfer ribbon (TTR) must be used. A resin based TTR such as that described in U.S. Pat. No. 5,747,146, has a much higher heat tolerance that allows the images it forms to be exposed to a heat bar of shrink-wrap equipment without picking. However, resin based TTR can be two or three times more expensive than its wax and wax/resin counterparts. So there is a desire to provide a wax/resin based TTR which is effective. The present invention allows for a lower cost alternative to using resin based TTR in conjunction with CD and DVD spine labels, for example, while achieving the same or similar performance.

The resin coated flexible substrates of this invention are comprised of a flexible support layer coated with a resinous coating. The flexible support layer can vary widely in composition and thickness. Materials used for conventional labels such as papers and synthetic polymer resin films are suitable.

A wide variety of papers and synthetic polymer resin film materials are useful in preparing the resin coated substrates of the present invention. For example, the synthetic polymer resin film material may include polymers and copolymers such as at least one polyolefin, polyacrylate, polystyrene, polyamide, polyvinyl alcohol, poly(alkylene acrylate), poly (ethylene vinyl alcohol), poly(alkylene vinyl acetate), polyurethane, polyacrylonitrile, polyester, polyester copolymer, fluoropolymer, polysulfone, polycarbonate, styrene-maleic anhydride copolymer, styrene-acrylonitrile copolymer, ionomers based on sodium or zinc salts of ethylene methyacrylic acid, polyacrylonitrile, alkylene-vinyl acetate copolymer, or mixtures of two or more thereof.

The polyolefins which can be utilized as the flexible support layer include polymers and copolymers of olefin monomers containing 2 to about 12 carbon atoms such as ethylene, propylene, 1-butene, etc., or blends of mixtures of such polymers and copolymers. In one embodiment, the polyolefins comprise polymers and copolymers of ethylene and propylene. In another embodiment, the polyolefins comprise propylene homopolymers, and copolymers such as propylene-ethylene and propylene-1-butene copolymers. Blends of polypropylene and polyethylene with each other, or blends of either or both of them with polypropylene-polyethylene copolymer also are useful. Polyolefins containing ionic bonding of molecular chains (ionomers) also are useful. A number of useful propylene homopolymers are available commercially from a variety of sources such as Dow Chemical, Fina and Montel.

Examples of polyamide resins useful as flexible support layers include resins available from EMS American Grilon Inc., Sumter, S.C. under the general tradename Grivory. Other useful polyamide resins include those commercially available from, for example, International Paper of Wayne, N.J. under the Uni-Rez product line, and dimer-based polyamide resins available from Bostik, International Paper, Fuller and Henkel.

Polystyrenes can also be utilized as the flexible support layer and these include homopolymers as well as copolymers of styrene and substituted styrene such as alphamethyl styrene. Examples of styrene copolymers and terpolymers include: acrylonitrile-butene-styrene (ABS); styrene-acrylonitrile copolymers (SAN); styrene butadiene (SB); styrene-maleic anhydride (SMA); and styrene-methyl methacrylate (SMMA); etc. An example of a useful styrene copolymer is KR-10 from Phillips Petroleum Co.

Polyurethanes also can be utilized as the flexible support layer, and the polyurethanes may include aliphatic as well as aromatic polyurethanes. Useful polyurethanes include aromatic polyether polyurethanes, aliphatic polyether polyurethanes, aromatic polyester polyurethanes, aliphatic polyester polyurethanes, aromatic polycaprolactam polyurethanes, and aliphatic polycaprolactam polyurethanes.

Polyesters prepared from various glycols or polyols and one or more aliphatic or aromatic carboxylic acids also are useful materials for flexible support layers. Polyethylene terephthalate (PET) and PETG (PET modified with cyclohexanedimethanol) are useful materials which are available from a variety of commercial sources including Eastman and duPont. Polycarbonates also are useful, and these are available from the Dow Chemical Co. (Calibre) G.E. Plastics (Lexan) and Bayer (Makrolon).

Acrylate polymers and copolymers and alkylene vinyl acetate resins (e.g., EVA polymers) also are useful as the flexible support layer in the preparation of the resin coated flexible substrates of the invention.

In one embodiment, the flexible support layer may comprise a fluorinated polymer. The fluorinated polymer may be polyvinylidene fluoride (PVDF), or copolymers and terpolymers of vinylidene fluoride.

The flexible support layer may be free of inorganic fillers and/or pigments for clear labels, or the flexible support layer may be cavitated and/or contain inorganic fillers and other organic or inorganic additives to provide desired properties such as appearance properties (opaque or colored films), durability and processing characteristics. Nucleating agents can be added to increase crystallinity and thereby increase stiffness. Examples of useful materials include calcium carbonate, titanium dioxide, metal particles, fibers, flame retardants, antioxidant compounds, heat stabilizers, light stabilizers, ultraviolet light stabilizers, antiblocking agents, processing aids, acid acceptors, etc.

The flexible support layer can be a monolithic layer or it can be a composite of two or more layers of different or identical materials. Materials used for conventional CD and DVD spine labels are well suited for the resin coated substrates of this invention.

Where the resin coated flexible substrate is a label, it additionally comprises a layer of adhesive applied to one side of the flexible support layer. The adhesive can be a conventional pressure-sensitive adhesive used for conventional labels. These include adhesives based on silicone resins, ethyl vinyl acetate copolymers, polyurethanes, polychloroprenes, polybutadienes, butadiene acrylonitrile rubbers, natural rubbers, styrene butadiene rubbers, acrylics, polyisobutylenes, butyl rubbers, higher polyvinyl alkyl ethers, S—B—S block copolymers, polyacrylate esters, vinyl ethers, styrene-isoprene butadiene acrylonitrile polymers. Preferred pressure-sensitive adhesives include hot melt pressure-sensitive adhesives. The pressure sensitive adhesive can be U.V. curable where desired. Effective hot-melt, silicone resin-based, pressure-sensitive adhesives are described in U.S. Pat. No. 5,482,988. Solvent-based pressure-sensitive adhesives, as well as water-borne adhesives, are suitable as well. Suitable solvent-based silicone resin, pressure-sensitive adhesives include those described in U.S. Pat. Nos. 4,460,371 and 5,100,976. U.S. Pat. No. 5,489,624 describes suitable hydrophilic polyethylene oxide-based pressure-sensitive adhesives. U.S. Pat. No. 4,647,504 describes suitable adhesive dispersions based on methylacrylate, styrene and methacrylate polymers. U.S. Pat. No. 5,512,612 describes suitable water dispersible, poly(alkoxyalkyl)acrylate polymers and U.S. Pat. No. 5,716,701 describes suitable acrylic copolymer emulsions.

The CD and DVD spine labels of this invention preferably employ the adhesives used for conventional CD and DVD spine labels such as water based or hot melt acrylic resins.

The flexible support layer is coated with a resin to obtain the resin coated flexible substrates of this invention. For the labels of this invention, the resin coating is applied to the side opposite the adhesive and a major portion of the resin coating (at least 50%) is comprised of a resin with a softening point below 150° C. Where the label is to be printed on with a thermal transfer printer, it is preferable that the resin have a softening point below the operating temperature of a thermal print head of the thermal transfer printer to be used. The operating temperature of a thermal print head within a conventional thermal printer can range from 100° C. to 300° C. The actual operating temperature of the thermal print head is difficult to measure due to the small size of the heating elements. A resin coating can be tested to determine if it is suitable if it is found to soften or melt in response to the operating print head. A resin coating comprised of a resin with a softening point below 150° C., more preferably from 100° C. to 150° C. will be suitable for use in conventional thermal transfer printers. The melting point of the resin can be below 150° C. but is preferably above 100° C.

Suitable resin coatings comprise those resins used in thermal transfer inks. These include but are not limited to the following resins: polyvinylchloride, polyvinyl acetate, vinyl chloride-vinyl acetate copolymers, polyethylene, polypropylene, polyacetal, ethylene-vinyl acetate copolymer, ethylene alkyl (meth)acrylate copolymer, ethylene-ethyl acetate copolymer, polystyrene, styrene copolymers, polyamide, ethylcellulose, epoxy resin, polyketone resin, polyurethane resin, polyvinyl butyryl, styrene-butadiene rubber, nitrile rubber, acrylic rubber, ethylene-propylene rubber, ethylene alkyl (meth)acrylate copolymer, acrylic acid-ethylene-vinyl acetate terpolymer, saturated polyesters, and sucrose benzoate of a molecular weight and polymer structure which will soften or melt in response to the heat from a thermal print head.

The resin coating is preferably sufficiently thin such that the portion of the resin coating beneath an operating thermal transfer print head melts or softens completely through to the flexible support layer. For certain resin layers, it is only necessary that at least 12 the thickness of the resin layer melts or softens in response to an operating thermal transfer print head.

To obtain a thin coating, the resin coating is preferably applied to the flexible support layer in the form of a conventional overprint varnish formulation, which typically contains one of the resins above, a pH control agent (buffer), a wetting agent, a defoaming agent, a wax and water. The resin coating preferably has a thickness of from 0.5 to 5.0 microns, more preferably from 1.0 to 2.5 microns.

Suitable overprint varnishes include any of the known clear to translucent yellow or brown, solid or semisolid, viscous substances of plant origin, such as copal, rosin and amber, as well as the numerous polymerized synthetics or chemically modified natural resins described above with softening points within the ranges prescribed above.

Conventional wetting agents, such as surfactants and Isopropyl Alcohol (IPA), are preferably used to achieve the desired wetting characteristics to properly coat the flexible support layer. No limitations are placed on the type of wetting agents, i.e., any may be used that achieve the desired wetting characteristics.

Suitable surfactants are, for example:

amphoterics such as alkyl polyamino carboxylates;

anionics such as alkyl phenol ether sulphates, alkyl ether sulfates, alkyl ether carboxylates, alkyl benzene sulfonates, alfa olefin sulfonates, alkyl naphthalene sulfonates, phosphate esters and sulfosuccinates;

cationics such as primary amines, secondary amines, tertiary amines, diamines, polyamines, amine salts, amidoamines, quaternary ammonium compounds, esterquats; and non-ionic surfactants such as alkanolamides, alcohol alkoxylates, alkyl glucosides, alkyl phenol alkoxylates, alkanolamide alkoxylates, amine oxides, castor oil ethoxylates, ethoxylated oils and acids, ethylene/propylene glycols, imidazolines, PEG esters, phenol ethoxylates and sorbitan ester.

Examples of photosensitive resinous overprint varnishes are varnishes of photosensitive cyclic rubber based resins, photosensitive phenol based resins, photosensitive polymethacrylate based resins, photosensitive polyamide based resins, and photosensitive polyimide based resins, and varnishes of unsaturated polyester based resins, polyester acrylate based resins, polyepoxyacrylate based resins, polyurethane acrylate based resins, polyether acrylate based resins, and polyol acrylate based resins.

Examples of non-photosensitive resinous varnishes are cellulose acetate based resins, nitrocellulose based resins, styrene based (co)polymers, polyvinyl butyral based resins, aminoalkyd based resins, polyester based resins, amino resin-modified polyester based resins, polyurethane based resins, acryl polyol urethane based resins, soluble polyamide resins, soluble polyimide based resins, soluble polyamidoimide based resins, soluble polyester imide based resins, casein, hydroxyethyl cellulose, water-soluble salts of styrene-maleic acid ester based copolymers, water-soluble salts of acrylic acid ester based (co)polymers or of methacrylic acid ester based (co)polymers, and water-soluble aminoalkyd based resins. These may be employed individually or in combination.

Preferred overprint varnishes for use in this invention have proved to be acrylics and polyurethanes dispersed in water, specifically those with an affinity to polypropylene flexible substrates; however, no limitation on the type of overprint varnish is present provided it melts in response to the heat and pressure from a thermal print head of a conventional thermal transfer printer.

The resin coated flexible substrates of this invention are well adapted to receive print from a thermal transfer ribbon in a thermal transfer printing process and provide stable heat resistant images.

In a method of this invention, a flexible support layer has a coating of resin applied to it to form a resin coated substrate of this invention. The flexible substrate and resin coating are as defined above.

In another method of this invention, the ink from a TTR is printed over top of the resinous coating of the resin coated substrate of this invention with a thermal transfer printer. The coating method and printing method of this invention can be performed sequentially.

To print with a TTR, a thermal process is used where the ink is melted and transferred via heat and pressure at the print head. When printing, the heat at a print head is concentrated enough to soften or melt not only the ink from the TTR, but also a portion of the resin coating of the resin coated substrate of this invention. The fluidized thermal transfer ink and resin coating become softened or fluidized during printing and come in contact. It is at this point that the two fluids (fluid thermal transfer ink and fluid resin coating) blend. After this blending, the print is more resistant to abrasion such as picking, for example, during the shrink-wrapping process as the now thermal transfer ink blended with resin from the coating is more temperature resistant than the thermal transfer ink without resin from the resin coating blended therein. See FIG. 1 (standard spine label) and FIG. 2 (spine label with resinous coating).

The printing method of this invention provides printed substrates of this invention which comprise a flexible supporting layer, as described above, with a resin coating on at least one surface thereof, as described above, and a printed image on the resin coating. The printed image comprises a blend of the thermal transfer ink and the resin within the resin coating. The thermal transfer ink which forms the image is from a thermal transfer ribbon (TTR).

This blending allows a wax or wax/resin based thermal transfer ribbon to be used and still provide the proper heat and abrasion-resistance to a heat bar shrink-wrap system.

In a molten state, the waxes from the thermal transfer ink and resin from the coating preferably disperse to a mixture, preferably homogenous, at least to some extent, in forming a printed image. This is most likely to occur at portions of the image directly under the print head. There may be some areas in the image that are more concentrated in wax than in resin. This is not relevant, provided the image remains uniform in color and experiences an increase in abrasion resistance at high temperatures. It is not necessary to quantify the quality of the mixing other than to determine if the image formed has increased high temperature resistance and abrasion resistance (resistance to picking). What "homogeneous mixture" refers to here is that the image formed from the resin coating and TTR ink responds uniformly to the operating temperatures used in shrink-wrapping.

Upon drying/solidifying, the resins from the coating become part of the printed image, making the printed image more resinous. The addition of this resin coating has been found to provide the heat resistance necessary to prevent picking when using a TTR with a wax/resin blend thermal transfer ink in combination with a heat bar shrink-wrap system. TTR's with wax based thermal transfer inks show similar results; however, the best results occur with the use of wax/resin thermal transfer inks.

As a result, the printed image is more resinous prior to shrink-wrapping because it is mixed with the resin coating. The more resinous the printed image, the more it is protected from picking, which in addition to being caused by heat during shrink-wrapping, may also occur due to scuffing, for example, and damage from other physical or chemical interactions during shrink-wrapping and/or handling during packaging.

Preferably, the resin coating is first applied to the flexible supporting layer in a wet state (varnish) and then dried. Once dry, the ink from the TTR can be printed on top of it. Where the resin coated flexible substrate is a label, the resin coating is preferably applied in the label manufacturing process.

In a preferred embodiment, the resin coating is an overprint varnish which dries to 100% resin, or close to being 100% resin, and the ink from the TTR is about 50% wax and 50% resin. The amount of resin and wax in the printed image (final blend at the location of printing, melting and mixing) depends on how much ink from the TTR is applied. A preferred range for the amount of resin and wax in the final blend is about 65-80% resin and 20-35% wax by weight, more preferably about 70-80% resin and 20-30% wax, most preferably about 72% resin and 28% wax.

Although not being bound by theory, it is believed that the two components (resin and wax) are mixed such that no chemical bonding (or cross-linking) occurs, although it may occur, maybe to a small extent. The components (although dry) are believed to simply be in a mixed state, not chemically bonded in any fashion.

Also provided by this invention is a printed substrate of this invention which is in the form of a label adhered to an article that is covered in shrink-wrap. The shrink-wrap is positioned over the printed substrate. A preferred embodiment is a spine label for a CD or DVD case covered in shrink-wrap.

Figure 1:
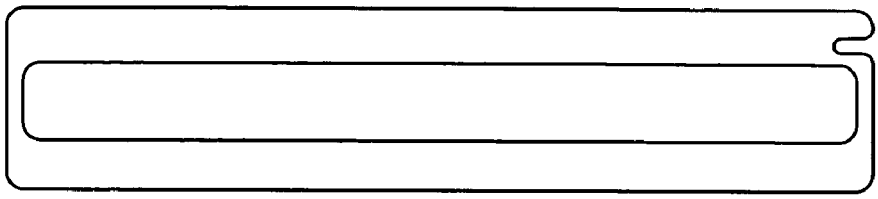
FIG. 1: Standard Spine Label.
Figure 2:
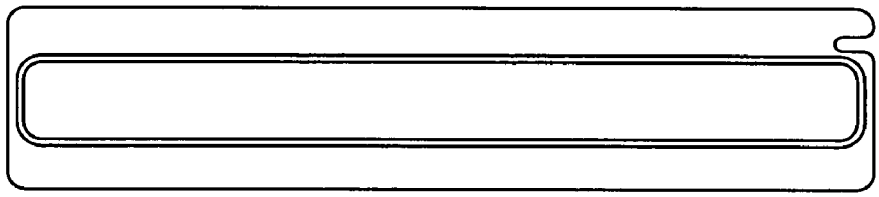
FIG. 2: Spine Label with. Resinous Over-Varnish of the present invention.
Figure 3:
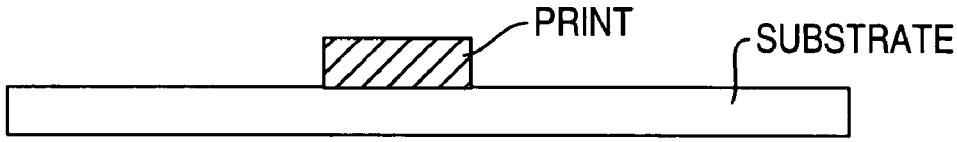
FIG. 3: Side view of a standard printed label.
Figure 4:
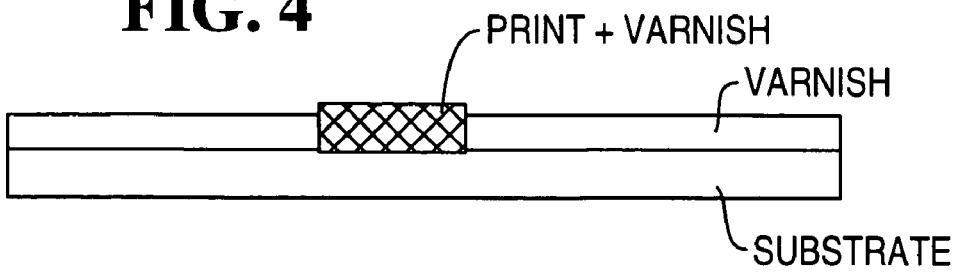
FIG. 4: Side view of printed label of the present invention.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever. In the foregoing and in the examples, all temperatures are set forth uncorrected in degrees Celsius and, all parts and percentages are by weight, unless otherwise indicated.

EXAMPLES

Experiment: Print Wax based, Wax/Resin based, and full resin thermal transfer ribbons on CD/DVD Spine Label substrates to determine performance in a CD/DVD shrink wrap application. Specifically being determined is the amount of pick (or ribbon transfer) from the spine label to the shrink wrap during the shrink wrap heat-seal process. The following thermal transfer ribbon products will be used.

Thermal Transfer Ribbons

A) Wax Based TTR—Consisting primarily of carnauba and paraffin waxes.

B) Wax/Resin TTR—Consisting of a mix of carnauba wax, paraffin wax, polyurethane resins, and acrylic resins.

C) Resin TTR—Consisting of a mix of acrylic resins, polyurethane resins, and polyester resins.

Each TTR product will be printed on the following:

1) Uncoated Spine Label and

2) Resinous Varnish Coated Spine Label

3) Dyne Adjusted coated spine label (Dyne adjustment for better TTR image)

The printed spine labels will then be placed exposed to a heat seal process conforming to industry standard. These conditions are:

Temperature: 400 F

Pressure: 20 PSI

Seal Time: 0.8 seconds

Once sealed, the shrink wrap will be removed and inspected for pick (ribbon transfer). This will be graded on a visual basis and assigned a value of 1 to 5, with 5 being no transfer and 1 being complete image transfer.

Results

| Ribbon | Spine Label | Result |
|---|---|---|
| A | 1 | 1 - Complete Transfer |
| B | 1 | 3 - Partial Transfer |
| C | 1 | 5 - No Transfer |
| A | 2 | 3 - Partial Transfer |
| B | 2 | 5 - No Transfer |
| C | 2 | 5 - No Transfer |
| A | 3 | 1 - Complete Transfer |
| B | 3 | 3 - Partial Transfer |
| C | 3 | 5 - No Transfer |

Therefore, picking was reduced greatly for wax and wax/resin based TTR when the resinous spine label was used. Conventional spine labels show severe picking for wax based TTR and moderate picking (partial transfer) for wax/resin based TTR products. The use of a dyne adjusted spine label replicated the performance or the uncoated spine labels.

The preceding examples can be repeated with similar success by substituting the generically or specifically described reactants and/or operating conditions of this invention for those used in the preceding examples.

The entire disclosures of all applications, patents and publications, cited herein are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A printed substrate comprising a) a flexible supporting layer with a b) resin coating positioned on at least one surface of said flexible supporting layer, said resin coating having a thickness of from 0.5 to 5.0 microns, and c) a printed image on said resin coating formed from a thermal transfer ribbon by a thermal transfer printing process, wherein said printed image comprises a blend of a thermal transfer ink from the thermal transfer ribbon and at least one resin within said resin coating.

2. A printed substrate as in claim 1 wherein the thermal transfer ink from the thermal transfer ribbon comprises at least 50% wax and the printed image on a surface with said resin coating comprise less than 50% wax.

3. A printed substrate as in claim 2 wherein the printed image on the surface has an increased resistance to abrasion and high temperatures as compared to the thermal transfer ink on the thermal transfer ribbon.

4. A printed substrate as in claim 2 wherein a major portion of said resin coating comprises a resin with a softening point below 150° C.

5. A printed substrate as in claim 4 which is a label that further comprises an adhesive layer on the surface of the flexible supporting layer opposite the resin coating.

6. A printed substrate as in claim 5 which is a spine label for a CD or DVD case.

7. A printed substrate as in claim 6 wherein the flexible supporting layer comprises a polyolefin resin and a major portion of the resin coating comprises an acrylic resin or polyurethane resin.

8. A printed substrate as in claim 5 which is a label applied to an article that is wrapped with shrink wrap and said shrink wrap is positioned over said label.

9. A label for the spine of a CD or DVD case comprising a flexible support layer coated with a pressure sensitive adhesive on one surface of said flexible support layer and a resin coating positioned on the surface of the flexible support layer opposite the pressure sensitive adhesive, wherein said resin coating has a thickness which ranges from 0.5 to 5.0 microns, and a major portion of said resin coating comprises a resin with a softening point below 150° C.

10. A label as in claim 9 wherein said resin coating is an overprint varnish.

11. A label as in claim 9 wherein a portion of the resin coating beneath an operating thermal print head of a thermal transfer printer will melt.

12. A label as in claim 9 additionally comprising a printed image on said resin coating formed from a thermal transfer ribbon by a thermal transfer printing process.

13. A label as in claim 12 wherein said printed image comprises a blend of the resin with said resin coating and the thermal transfer ink of said thermal transfer ribbon.

14. A label as in claim 12 which is applied to the spine of a CD or DVD case that is wrapped with shrink wrap wherein said shrink wrap is positioned over said label and the printed image is undisturbed by said shrink wrap.

15. A label as in claim 9 wherein the flexible support layer comprises a polyolefin resin and a major portion of the resin coating comprises an acrylic resin or polyurethane resin.

16. A label as in claim 9 which is applied to the spine of a CD or DVD case that is wrapped with shrink wrap wherein said shrink wrap is positioned over said label.

17. A method for printing an image on a resin coated substrate, wherein said resin coated substrate comprises a flexible supporting layer with a resin coating positioned on at least one surface of said flexible support layer, said method comprising applying a thermal transfer ink from a thermal transfer ribbon to the resin coating, heating the thermal transfer ink to a temperature which softens or melts the thermal transfer ink and the resin coating beneath the thermal print head, maintaining the thermal transfer ink and resin coating molten for a period of which allows the thermal transfer ink to blend with the resin coating.

18. A method as in claim 17 wherein a thermal transfer ink with at least 50% wax is blended with the resin coating to form an image of less then 50% wax.

19. A method as in claim 17 wherein the resin coated substrate is prepared by coating a flexible polyolefin supporting substrate with an overprint varnish formulation comprised of a polyurethane resin or acrylic resin and drying said overprint varnish formulation to form a resin coating with a thickness in the range of 0.5 to 5.0 microns.

20. A method as in claim 17 wherein the flexible supporting layer does not melt when printing an image.

* * * * *